US007249392B1

(12) United States Patent
Paille

(10) Patent No.: US 7,249,392 B1
(45) Date of Patent: Jul. 31, 2007

(54) SELF WIPING TOILETRY DEVICE

(76) Inventor: Michel G. Paille, 6033 Old Antonia Rd., Imperial, MO (US) 63052

( * ) Notice: Subject to any disclaimer, the term of this patent is extended or adjusted under 35 U.S.C. 154(b) by 678 days.

(21) Appl. No.: 10/628,929

(22) Filed: Jul. 29, 2003

Related U.S. Application Data

(60) Provisional application No. 60/399,362, filed on Jul. 30, 2002.

(51) Int. Cl.
*A47K 7/04* (2006.01)
*A47K 7/08* (2006.01)
*A47K 10/16* (2006.01)

(52) U.S. Cl. ..... 15/210.1; 15/150

(58) Field of Classification Search ..... 15/210.1, 15/150
See application file for complete search history.

(56) References Cited

U.S. PATENT DOCUMENTS 1,192,330 A * 7/1916 Leppart ..... 15/150
2,947,564 A * 8/1960 Winther ..... 294/100
5,630,243 A * 5/1997 Federico et al. ..... 15/104.94
6,158,077 A * 12/2000 Wenger et al. ..... 15/210.1
6,272,716 B1 * 8/2001 Thornton ..... 15/210.1
6,611,986 B1 * 9/2003 Seals ..... 15/210.1

OTHER PUBLICATIONS

Advertisement from SHORTDWARF.COM showing a device used for wiping dated Jan. 17, 2004.
Advertisement from DYNAMIC-LIVING.COM showing a device called the "Bottom Buddy" dated Jan. 16, 2004.

* cited by examiner

*Primary Examiner*—Randall Chin
(74) *Attorney, Agent, or Firm*—Kevin L. Klug

(57) ABSTRACT

A self wiping toiletry device and method of use which utilizes a jaw system and release button to hold and release toilet paper for wiping. The apparatus and method is especially useful for handicapped persons and those having limited use of one or both hands. The apparatus and method in its preferred form easily allows a person to roll toilet paper, install the rolled paper into the jaw system, use the rolled paper to wipe after toilet use, and thereafter easily dispense the soiled paper into the toilet water.

12 Claims, 14 Drawing Sheets

SELF WIPING TOILETRY DEVICE

This application claims priority of U.S. Provisional Patent Application Ser. No. 60/399,362, filed Jul. 30, 2002.

BACKGROUND OF THE INVENTION

The present invention relates in general to toiletry devices and more particularly to a device and method for promoting optimum personal hygiene, especially for persons having limited hand and/or arm function. The present art device specifically allows the aforesaid persons to function independently when using the restroom, and also assist persons lacking the physical dexterity to practice optimum personal hygiene when using the restroom by providing a device and method of use which allows a person to hygienically wipe after toilet use.

The device in its preferred assembled form comprises a nearly "L" shaped form having a hand grip and a thumb triggerable toilet paper release button at a first end. The aforesaid handgrip also functions as a toilet paper roller, utilizing a grip-release locking switch (much like a flash light switch), which allows release of the grip. Once released, the grip is allowed to spin freely and allow rolling of toilet paper prior to installation of said rolled paper on or near a second end of the device. The second end of the device comprises a gently-tapered toilet paper mandrel or spindle having a closed end, around which the aforesaid pre-rolled amount of toilet paper (to be pre-rolled by the user) is slid on the held in place by a retainer arm which mates with a groove in said mandrel, said groove and arm combination forming a jaw system. Said arm is actuated, i.e. opened and closed, with said toilet paper release button. That is, when said release button is depressed, the arm opens for placement or release of the aforesaid toilet paper preroll. In the preferred embodiment, the base of the "L" shape relates to the stem of the "L" shape with an approximately 75 degree minor angle for ease of use and conformance with the user's body. Alternative embodiments may increase or decrease this angle without departing from the scope and spirit of the present invention.

Accordingly, it is an object of the present invention to provide an improved self wiping toiletry device and method of use which provides an apparatus and method for a user to hygienically wipe after toilet use, especially when said user lacks physical dexterity to practice optimum personal hygiene without the aid of such a device.

Another object of the present invention is to provide a lightweight and easy to use self wiping toiletry device which assists the user in rolling toilet paper and further allows the user to utilize said rolled paper for wiping.

A further object of the present invention is to provide a self wiping toiletry device which provides the aforesaid benefits in a form which is easily and inexpensively molded.

A still further object of the present invention is to provide a self wiping toiletry device with all of the aforesaid features which easily disposes of and does not require the user to contact the soiled paper after use.

SUMMARY OF THE INVENTION

To accomplish the foregoing and other objects of this invention there is provided a self wiping toiletry device and method of use which is especially useful for promotion of personal hygiene among persons lacking the physical dexterity necessary to practice tradition wiping. The apparatus essentially comprises in a preferred embodiment, a substantially "L" shaped from having a rotating hand grip with a grip-release locking switch and a thumb triggerable toilet paper release button at a first end and a second end having a gently-tapered toilet paper mandrel or spindle with a closed end and a preferably serrated retainer arm, operated by said button, which mates with a preferably serrated groove in said mandrel, said groove and arm combination forming a jaw system.

The apparatus at the second end securely holds the aforesaid rolled section of toilet paper until the user is ready to release it from the device by pushing the release button on said first end. A unique and desirable aspect of the present art is that at no time must the user have contact with the soiled paper, nor must the device ever come in contact with the toilet water. The user simply pushes the release button after use and discards the paper into the toilet.

In its preferred form, the apparatus comprises a housing having a cavity formed from a first and second half, a linkage moveable positioned within said housing having said release button as a first end, a retainer arm having a torsion spring closure bias and pivotably mounted within said housing and extending externally along said mandrel or spindle, the aforesaid mandrel/spindle, the aforesaid locking switch slidably mounted within said housing, and the aforesaid hand grip which is rotatably mounted over said housing near said first end. A second end of the aforesaid linkage pivotably attaches with said retainer arm whereby said arm may be actuated or opened by said release button. The aforesaid torsion spring bias assures that the release button extends from said housing near said first end when not depressed by the user.

In the preferred embodiment, each half housing has one or more guides which fit within slots within said linkage and serve to mechanically position or control the movement of said linkage within the housing. Further contained within said housing halves is a pivoting shaft on which said retainer arm pivots. Said pivoting shaft is located near said second end of said housing and also preferably serves as the moment axis for said torsion spring.

The retainer arm comprises a front end elongated member having a top side contoured to follow and mate with at least a portion of the external portion or contour of said mandrel or spindle. Preferably said retainer arm follows a groove within said mandrel or spindle which also substantially follows the contour of said mandrel or spindle. In the preferred embodiment, said retainer arm mates with said mandrel on the bottom side or side farthest from said first end.

The device of the present invention may be manufactured from a plurality of materials, including but not limited to plastics, metals, woods, composites, and papers. In a preferred embodiment, all the components of the apparatus are composed of plastic material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
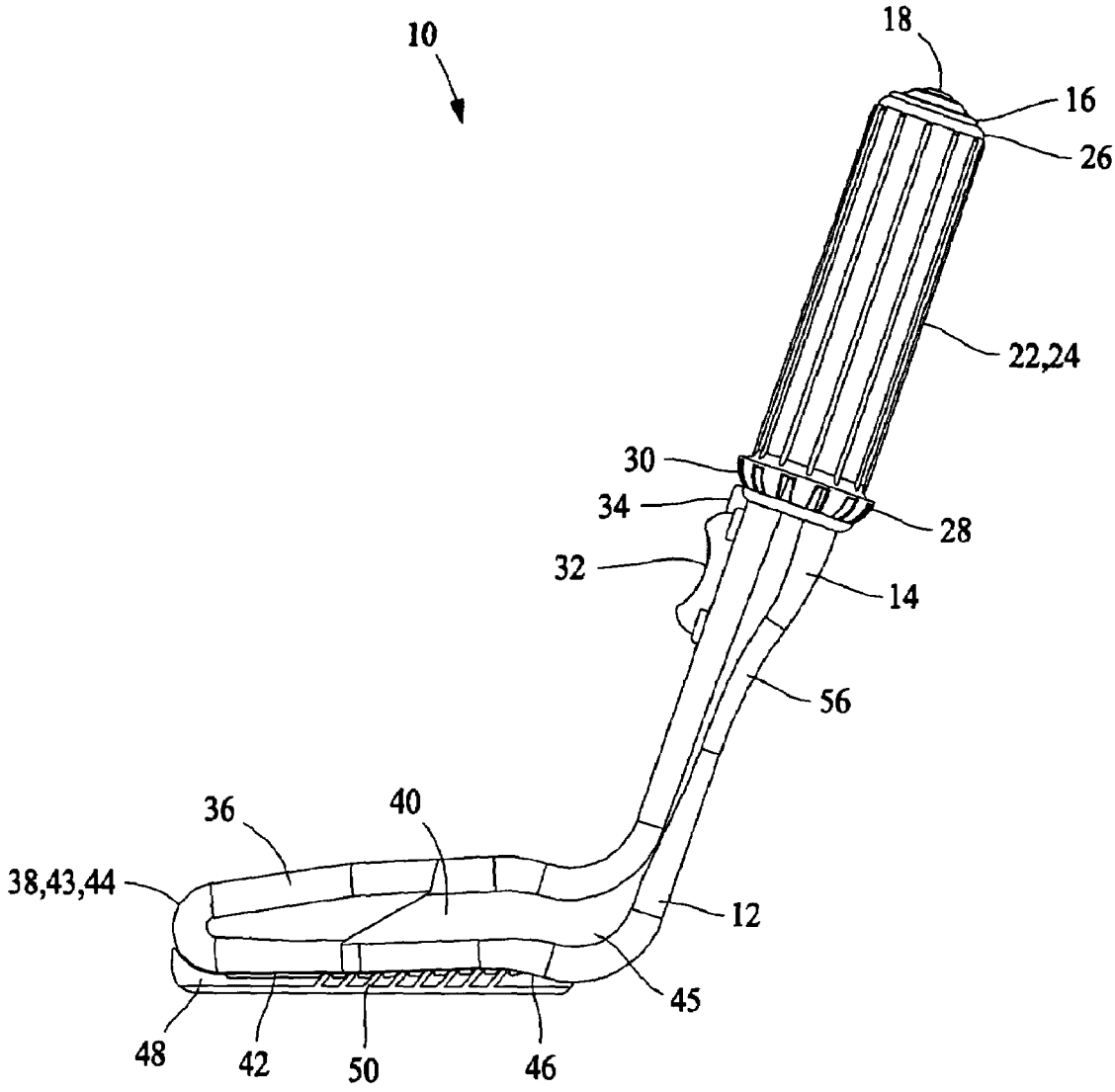
FIG. 1 is a right side plan view of the assembled self wiping toiletry device which is substantially symmetrical with a left side plan view.
Figure 2:
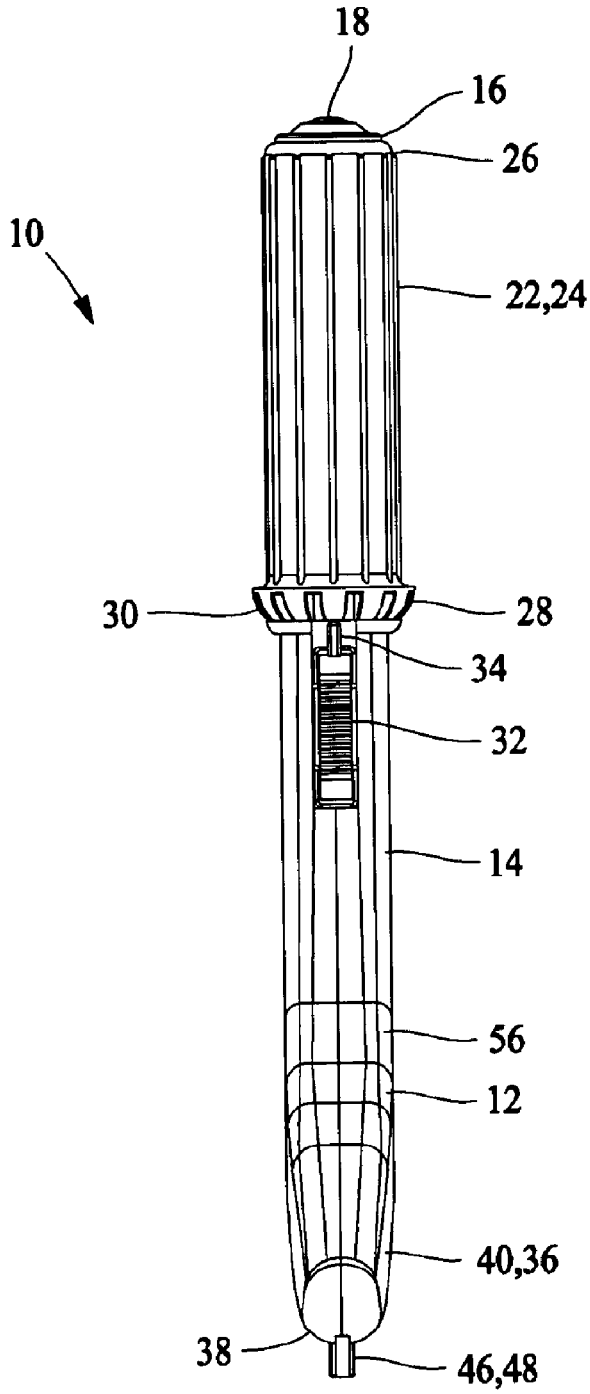
FIG. 2 is a front side plan view of the assembled apparatus.
Figure 3:
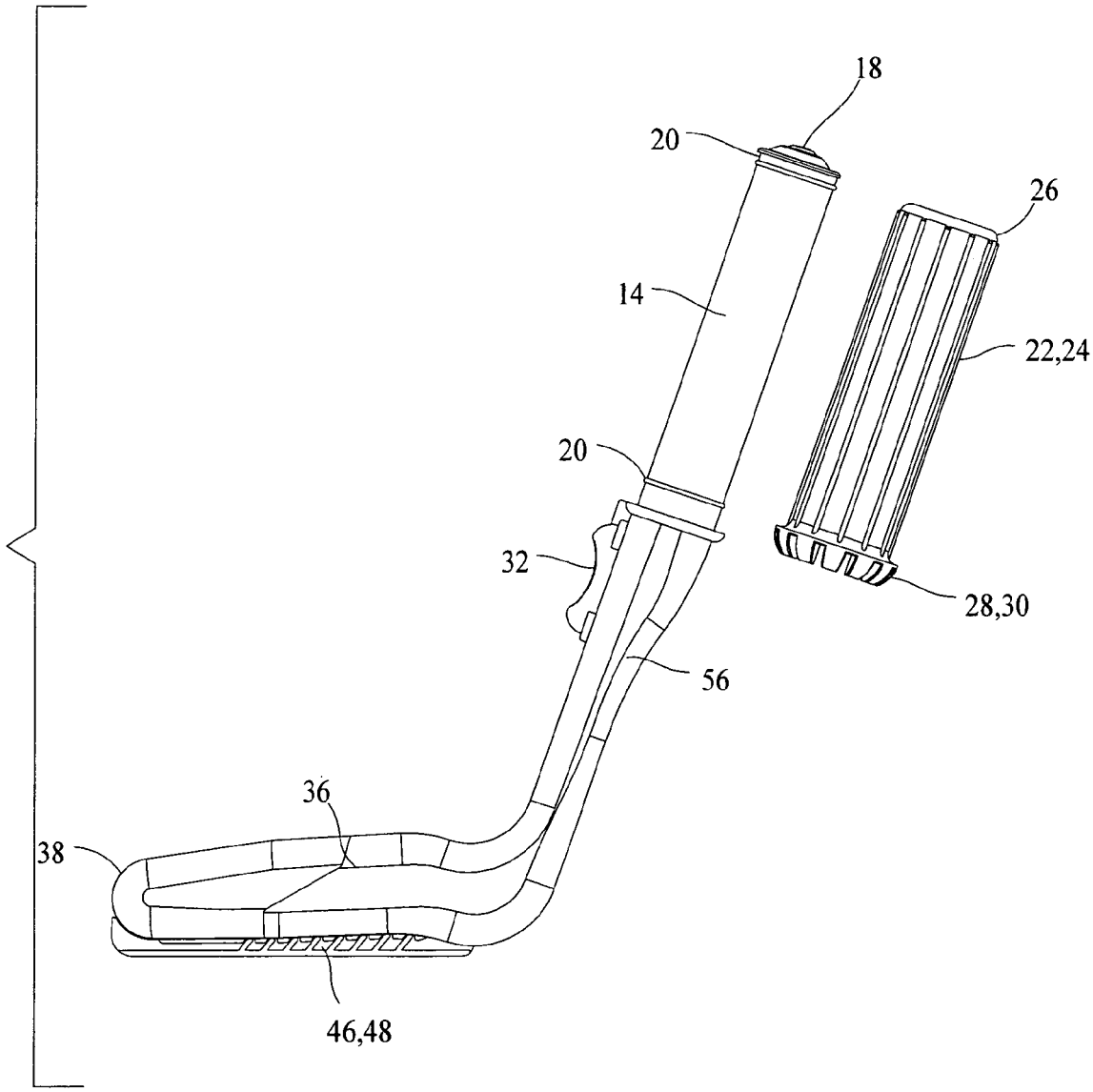
FIG. 3 is a right side plan view of the apparatus with hand grip removed and placed on the right side.
Figure 4:
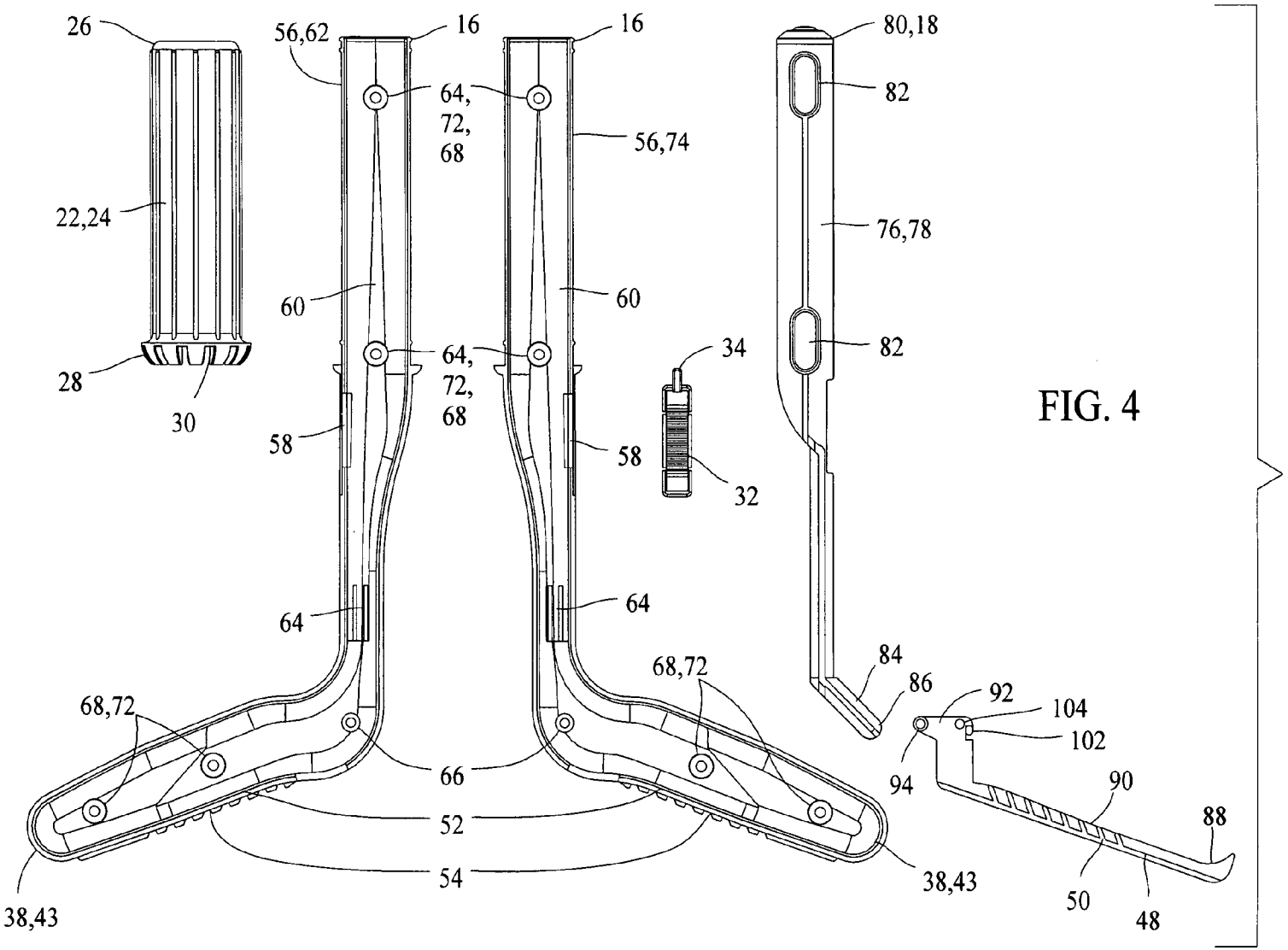
FIG. 4 is an assembly plan view of the dis-assembled self wiping toiletry device showing the two housing halves, linkage, retaining arm, mandrel, switch, and hand grip.
Figure 5:
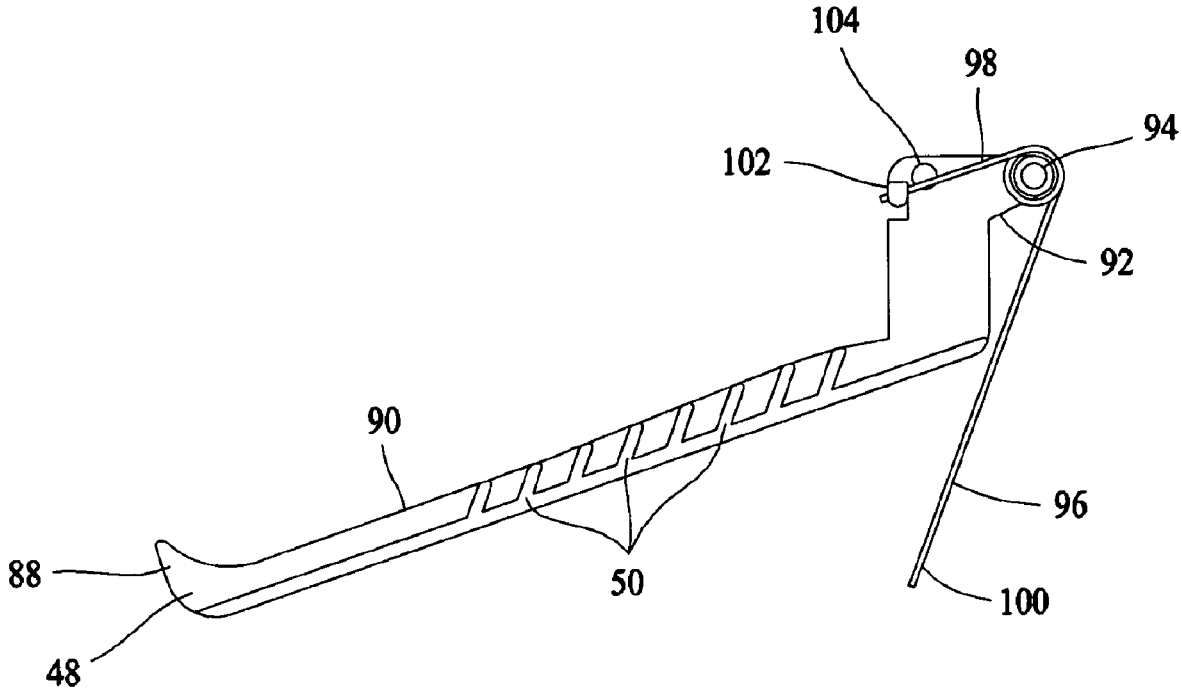
FIG. 5 is a left side exploded plan view of the retaining arm with attached torsion spring around the hub which is substantially symmetrical with the right side view thereof.
Figure 6:
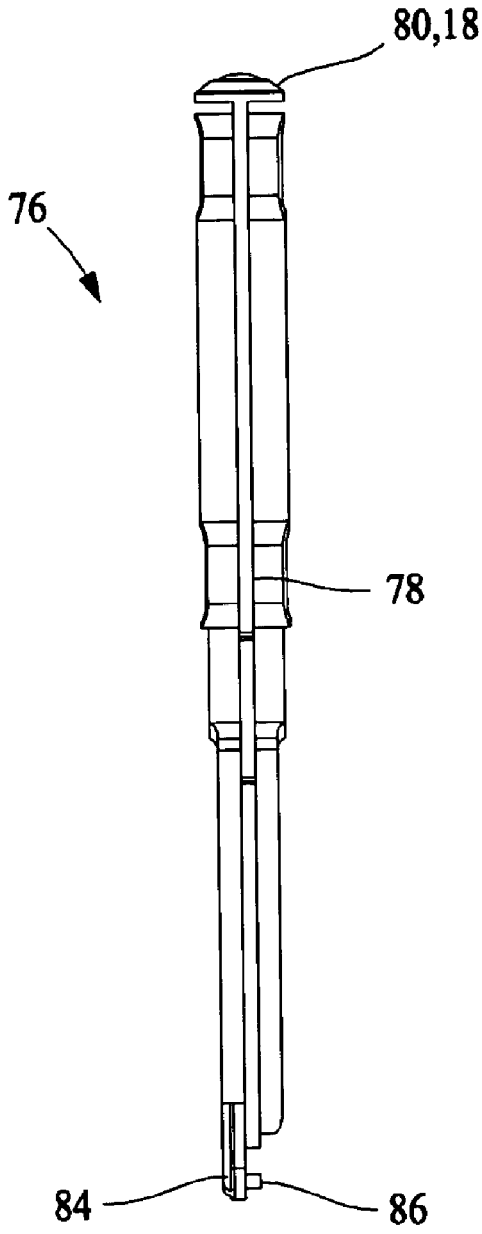
FIG. 6 is a back side plan view of the linkage showing the release button on the first end and the positioning shaft on the second end.
Figure 7:
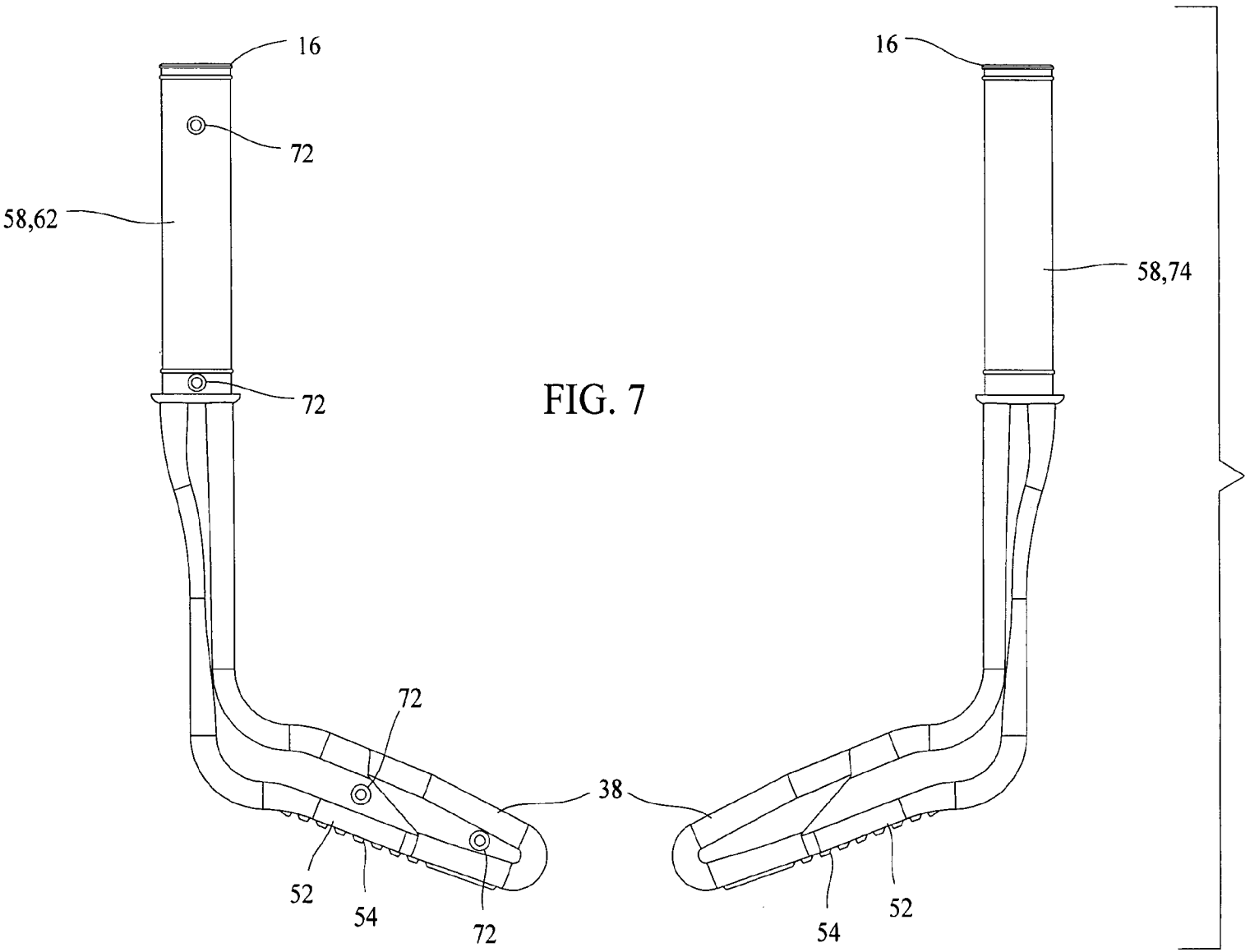
FIG. 7 is an external plan view of each half of the housing.
Figure 8:
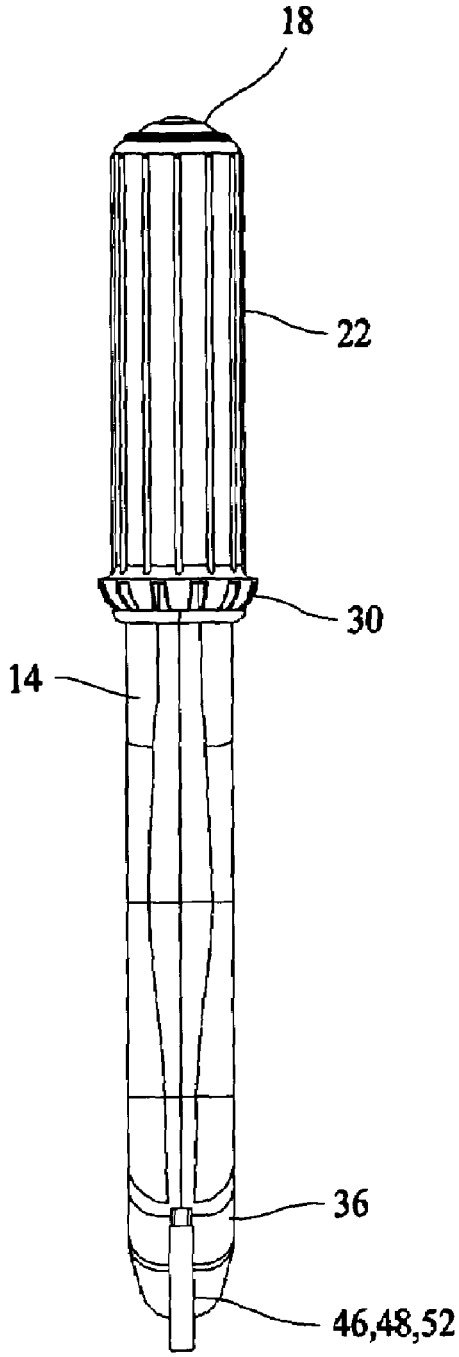
FIG. 8 is a rear side plan view of the assembled self wiping toiletry device.
Figure 9:
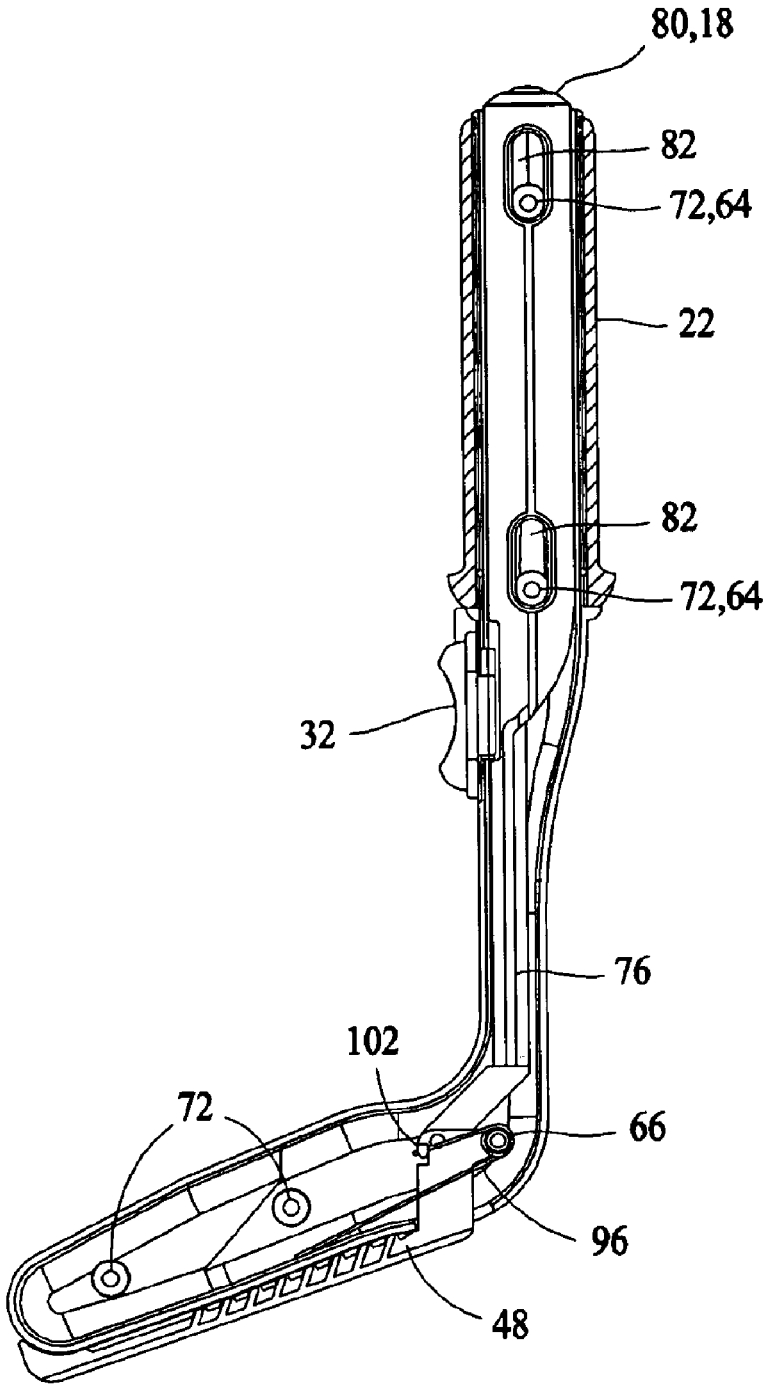
FIG. 9 right plan view of the assembled self wiping toiletry device showing the linkage, retaining arm, torsion spring, and locking switch in first half of the housing.
Figure 10:
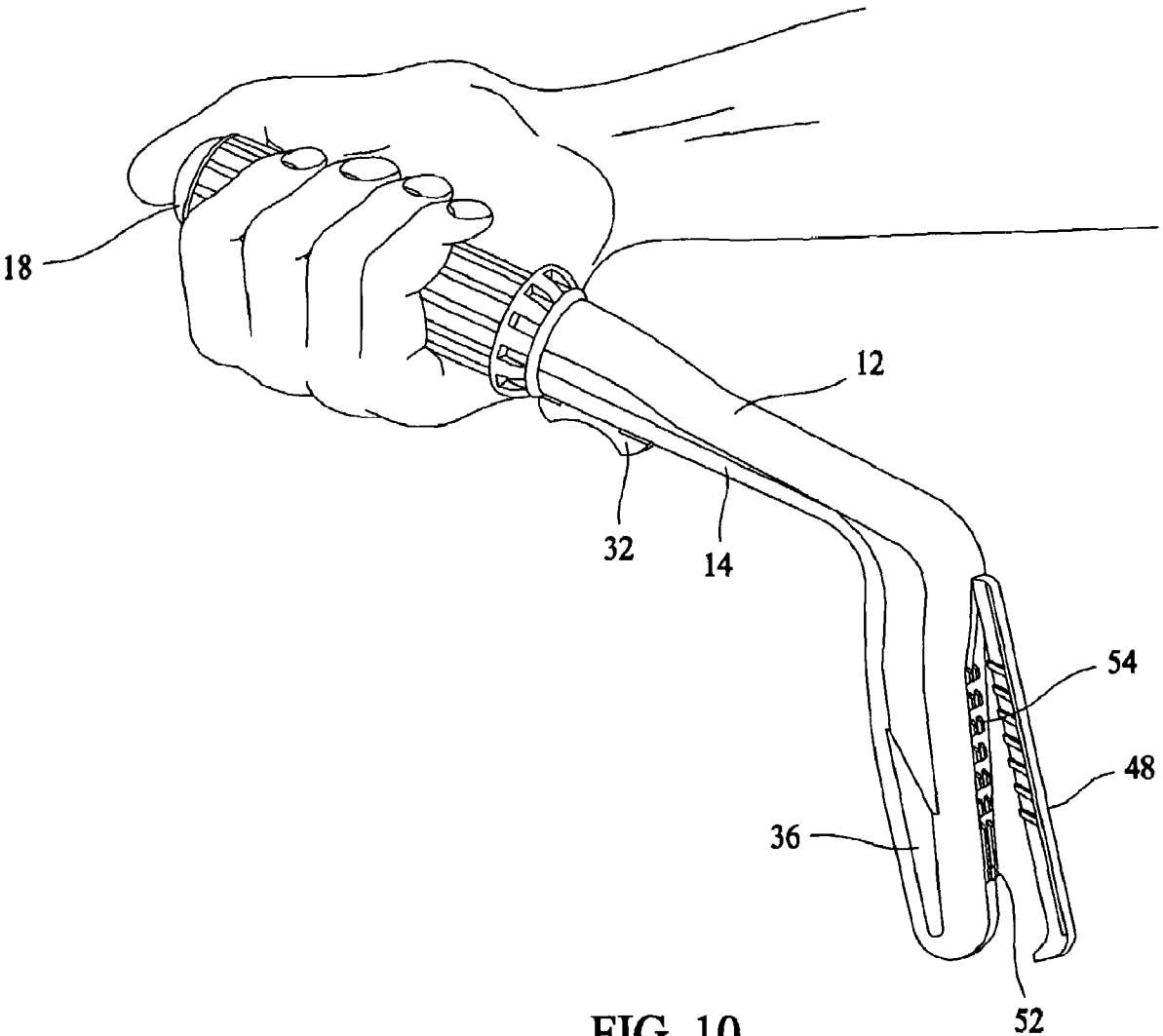
FIG. 10 is a perspective view of the assembled self wiping toiletry device showing its operation.
Figure 11:
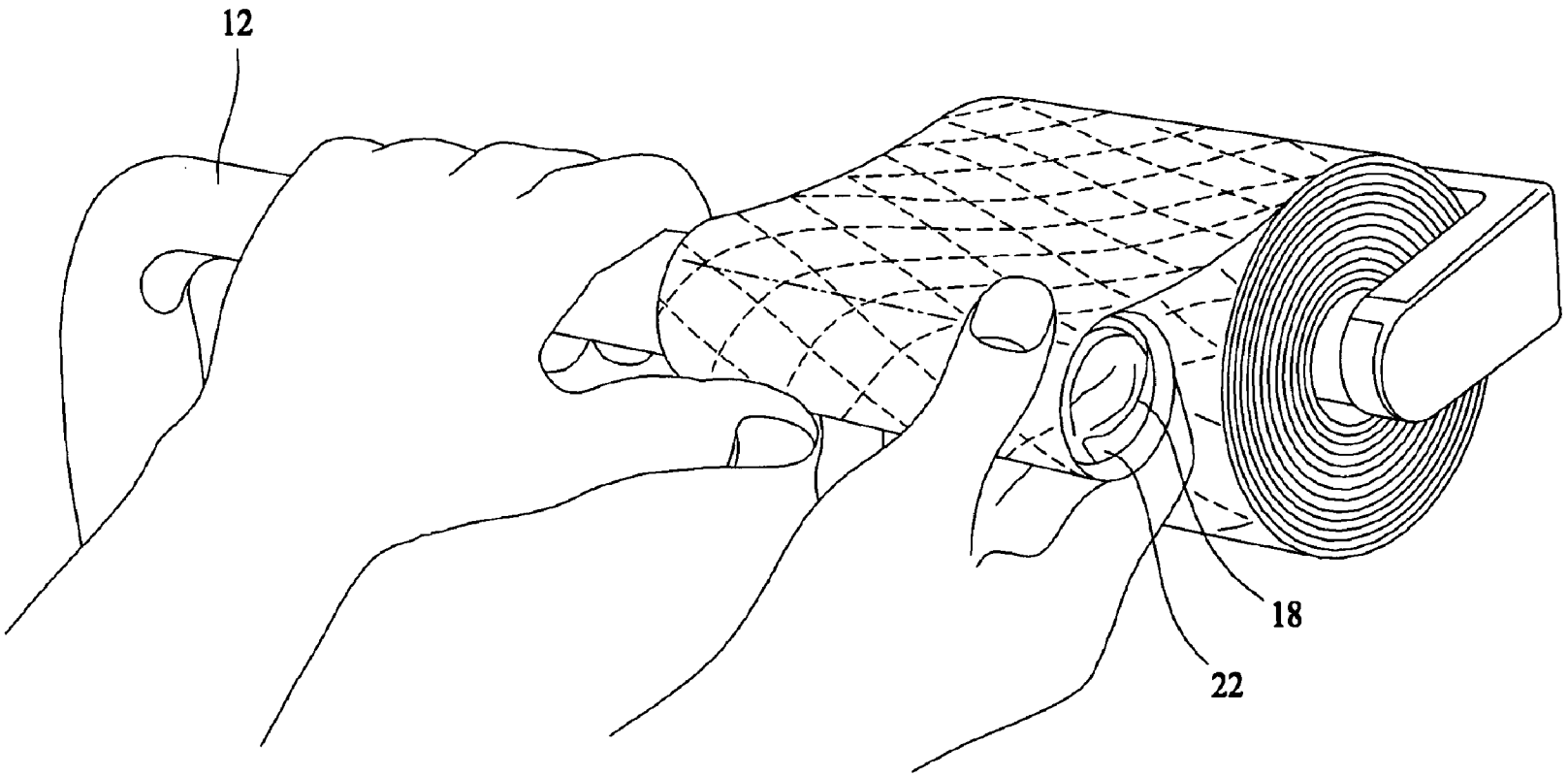
FIG. 11 is a perspective view of the assembled self wiping toiletry device showing its operation during toilet paper rolling.
Figure 12:
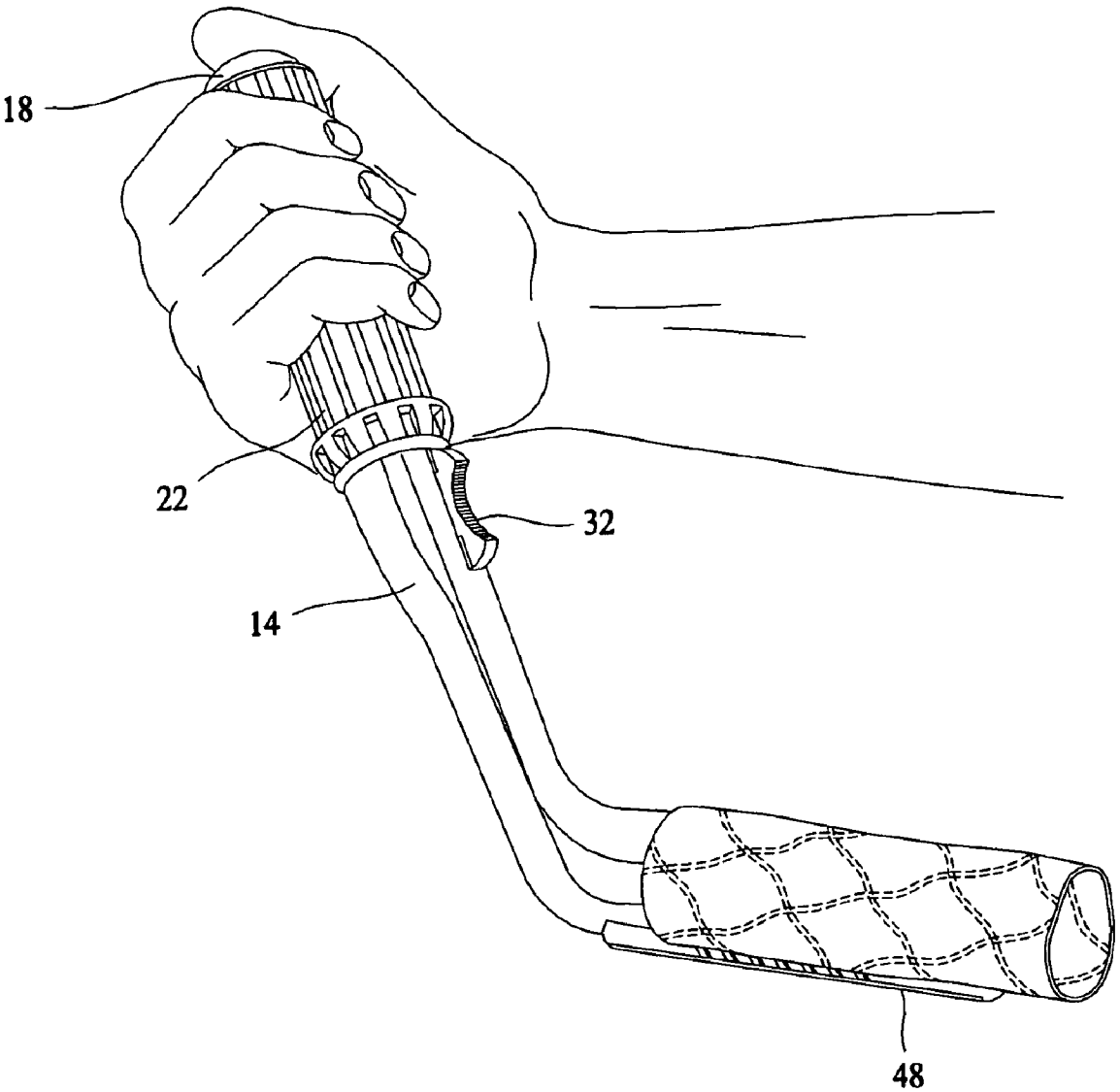
FIG. 12 is another perspective view of the assembled self wiping toiletry device showing its operation.
Figure 13:
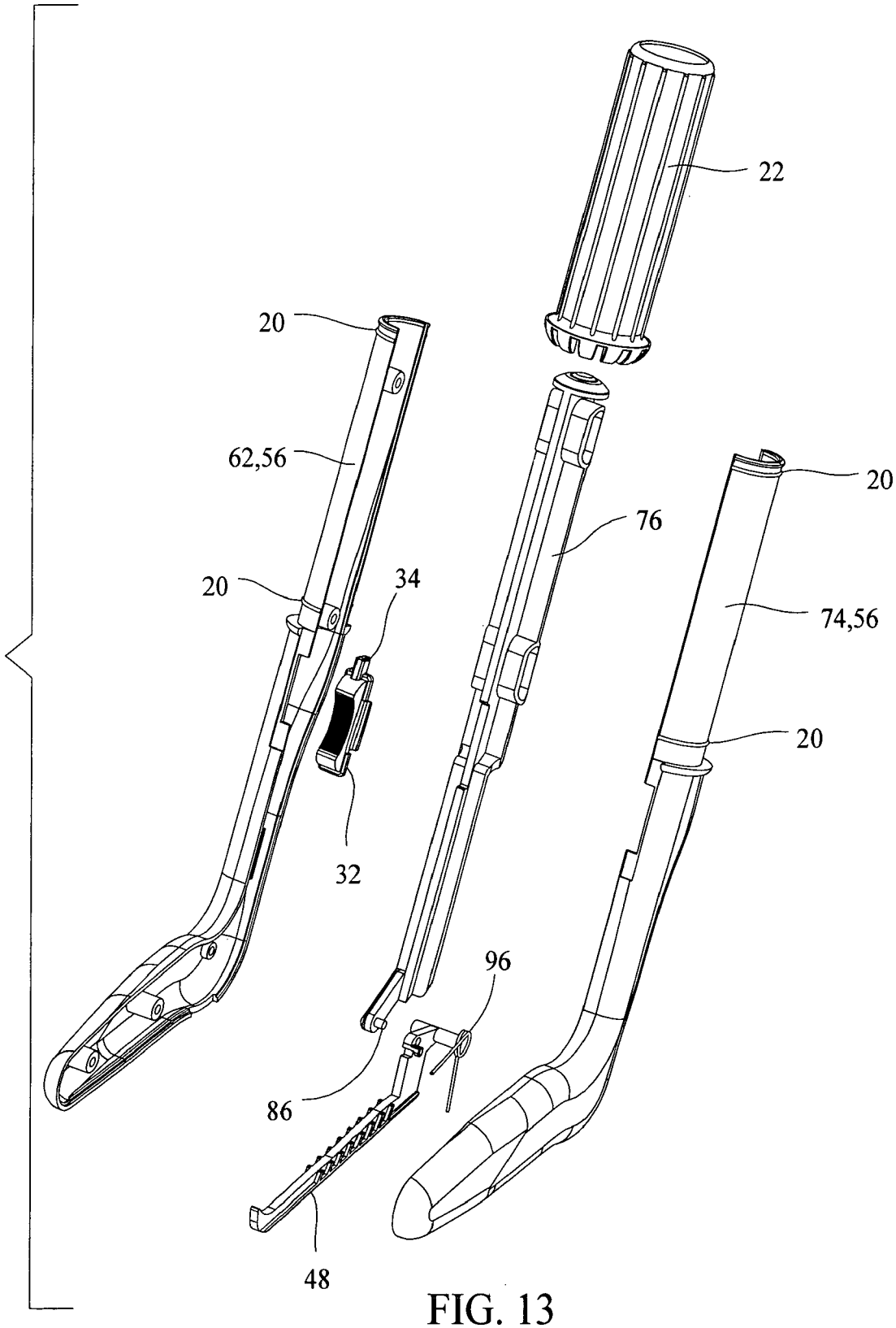
FIG. 13 is an exploded view of the parts of the self wiping device showing the relative position of each part to the other.
Figure 14:
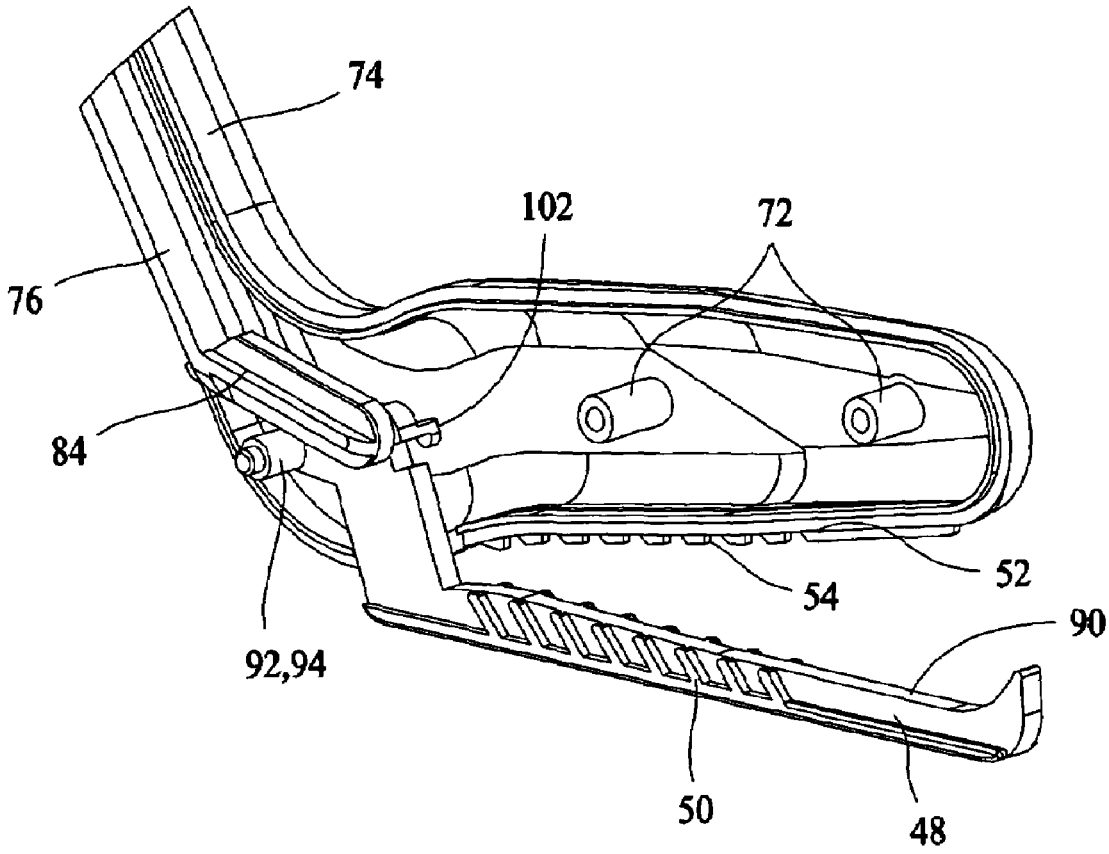
FIG. 14 is an exploded perspective view of the second half housing second end, linkage, and retainer arm as placed together.

Referring now to the drawings, there is shown in FIGS. 1-16 a preferred embodiment of the self wiping toiletry device 10 of the present invention. The apparatus and method of use of the present art is especially adapted to allow easy, convenient, and hygienic wiping after toilet use. A unique feature of the present invention is its ability to hold toilet paper for hygienic wiping and also assist the user to roll the paper prior to use. The apparatus and method presented allows for handicapped persons and those with limited arm movement to utilize toilet facilities without assistance from another person.

The drawings show the self wiping toiletry device 10 comprising a nearly "L" shaped form 12 forming a housing 56 and having a hand grip 22 and a thumb triggerable toilet paper release button 18 at a first end 16. The aforesaid handgrip 22 also functions as a toilet paper roller, utilizing a grip-release locking switch 32 (much like a flash light switch), which allows release of the grip 22. Once released, the grip 22 is allowed to spin freely and allow rolling of toilet paper prior to installation of said rolled paper on or near a second end 38 of the device 10. The second end 38 of the device 10 comprises a gently-tapered toilet paper mandrel or spindle 40 having a closed end 44, around which the aforesaid prerolled amount of toilet paper (to be pre-rolled by the user) is slid on and held in place by a pivoting retainer arm 48 which mates with a groove 52 in said mandrel, said groove 52 and arm 48 combination forming a jaw system 46. The jaw system 46 may take many forms and shapes in alternative embodiments such as clamps, pressing mechanisms, and spring loaded arms, with or without grooves yet having a gap for placement of toilet paper, without departing from the scope of the present art. Said arm 48 is actuated, i.e. opened and closed, with said toilet paper release button 18. That is, when said release button 18 is depressed, the arm 48 opens and forms a gap for placement or release of the aforesaid toilet paper preroll.

In the preferred embodiment, the base 36 of the "L" shape 12 relates to the stem 14 of the "L" shape 12 with an approximately 75 degree minor angle for ease of use and conformance with the user's body. Alternative embodiments may increase or decrease this angle without departing from the scope and spirit of the present invention. The apparatus at the second end 38 securely holds the aforesaid rolled section of toilet paper until the user is ready to release it from the device by pushing the release button 18 on said first end 26. A unique and desirable aspect of the present art is that at no time must the user have contact with the soiled paper, nor must the device ever come in contact with the toilet water. The user simply pushes the release button 18 after use and discards the paper into the toilet.

In its preferred form, the apparatus comprises a housing 56 having a cavity 60 formed from a first 62 and second half 74, a linkage 76 moveably positioned within said housing 56 having said release button 18 at a first end 80, a retainer arm 48 having a torsion spring 96 closure bias and pivotably mounted within said housing 56 and extending externally along said mandrel or spindle 40, the aforesaid mandrel/spindle 40, the aforesaid locking switch 32 slideably mounted within said housing 56, and the aforesaid hand grip 22 which is rotatably mounted over said housing 56 near said first end 16. A second end 84 of the aforesaid linkage 76 pivotable attaches with said retainer arm 48 whereby said arm 48 may be actuated or opened by opening movement of said release button 18. The aforesaid torsion spring 96 bias assures that the release button 18 extends from said housing 56 near said first end 16 when not depressed by the user. In a preferred embodiment said mandrel/spindle 40 is an integrally molded portion of said housing 56, as either a single piece or split halves following the half split line of the housing 56 halves. Further alternative embodiments may utilize other types of spring methods to provide said closure bias, including but not limited to linear compression or extension springs mounted to said linkage 76 or said retainer arm 48.

In the preferred embodiment each housing half 62, 74 is substantially symmetrical and has a nearly "L" shape 12 as aforesaid. Each housing half 62, 74 has one or more attachment means 68 integrally included within the cavity 60 of said first 62 and second half 74. In a preferred embodiment, said attachment means 68 comprise integrally formed holes or posts 72 for placement of screws, bolts, rivets, or other fasteners. Alternative embodiments may utilize one or more male and female snap fittings which mate and snap together to hold the halves together. Further alternative embodiments may utilize adhesives to attach said first 62 and second 74 halves.

In the preferred embodiments, each half housing 62, 74 has one or more guides 64 which fit within slots 82 within said linkage 76 or around said linkage 76 and serve to mechanically position or control the movement of said linkage 76 within the housing 56. Further contained within said housing halves 62, 74 is a pivoting shaft 66 on which said retainer arm 48 pivots. Said pivoting shaft 66 is located near said second end 38 of said housing 56 and also preferably serves as the moment axis for said torsion spring 96. Alternative embodiments may forego use of said guides 64 and simply allow the linkage 76 to float within said cavity 60 without departing from the spirit and scope of the present invention. Further alternative embodiments may utilize pins, screws, or other pivoting means to provide said pivoting shaft 66 for said retainer arm 48.

In the preferred embodiment, the linkage 76 is an elongated member 76 having the aforesaid slots 82 and further having a second end 84 angled approximately 45 degrees relative to the lengthwise axis of said elongated member 76. Said second end 84 further contains one or more positioning shafts 86 which mate and couple with said retainer arm 48 and allow said arm 48 to pivot on said pivoting shaft 66 via movement of the linkage 76. Alternative embodiments may vary the second end 84 angle from zero to 90 degrees without departing from the scope or spirit of the present invention. Further alternative embodiments may utilize pins, screws, mechanical abutment, flexible shafts, or other means to translate movement of said linkage 76 to said retainer arm 48.

The retainer arm 48 comprises a front end elongated member 88 having a top side 90 contoured to follow and mate with at least a portion of the external portion or contour of said mandrel or spindle 40. Preferably said retainer arm 48 follows a groove 52 within said mandrel or spindle 40 which also substantially follows the contour of said mandrel or spindle 40. In the preferred embodiment, said retainer arm 48 mates with said mandrel 40 on the bottom side 42 or side farthest from said first end 16. Alternative embodiments may place or mate said retainer arm 48 at any location on said mandrel 40 which may physically hold toilet paper. In the preferred embodiment, said retainer arm 48 contains one or more male serrations 50 which mate with one or more female serrations 54 within said groove 52. Further alternative embodiments may allow said retainer arm 48 to attach directly with said linkage and move to form a gap without pivoting.

The retainer arm 48 has a hub 94 located near a rear end 92 which mates with the pivoting shaft 66 of the housing 56. Preferably a torsion spring 96 wraps around said hub 94 with a first arm 98 of said torsion spring 96 attached or abutting with a tab 102 located on the retainer arm 48 and a second end 100 of said torsion spring 96 abutting against the housing 56 and or internal mandrel 40 cavity. As aforesaid, alternative embodiments may utilize other spring means located on said retainer arm 48 or said linkage 76 without departing from the scope of the present invention. The retainer arm 48 also has a linkage hole 104 into which the positioning shaft 86 of the linkage 76 pivotably mates. Said linkage hole 104 is preferably located between said hub 94 and said retainer arm 48 but in alternative embodiments may be located at any position on said retainer arm 48, provided said linkage 76 is functionally able to cause said arm 48 to pivot on said pivoting shaft 66.

In the preferred embodiment, said mandrel or spindle 40 is integrally molded with said stem 14 of said housing 56. In an alternative embodiment, said mandrel or spindle 40 comprises a substantially tubular form having a taper towards a closed 44 second end 43 with an open first end which mates with the assembled housing 56. Said open first end attaches with an alternative embodiment second end of said housing 56, preferably by sliding over said alternative embodiment second end and securing with a parallel or perpendicular screw. Alternative embodiments may attach said mandrel in a plurality of ways including but not limited to adhesives, solvent bonds, integral molding, or frictional fits.

The aforesaid locking switch 32 simply slidably mounts within a groove 58 or opening within said housing 56 and has a projection 34 which serves to lock and prevent rotation of the hand grip 22. The hand grip 22 is a substantially tubular structure 24 having a first end 26 and second end 28 which slides over the first end 16 of said housing 56 and rotates on said housing 56. The hand grip 22 is held onto said housing via grooves and/or extending rings 20 on said housing 56 which mate with the interior of said hand grip 22. In the preferred form, the hand grip 22 contains a plurality of notches 30 on a second end 28 which mate with said projection 34 on said locking switch 32 when locking is desired. Locking of said hand grip 22 is essential after toilet paper is installed on said mandrel 40. That is, in order to securely use the device the housing 56 cannot rotate relative to the hand grip 22. As aforementioned, it is desirable to have the hand grip 22 rotate when initially rolling toilet paper for placement onto the mandrel 40.

In operation and use, the user, if desired, unlocks the hand grip 22 and rotates toilet paper thereupon. Upon achieving the desired amount of roll, the user removes the toilet paper from the hand grip 22, pushes the release button 18, and places said toilet paper onto and or around said mandrel 40 and between said retainer arm 48. Once placed, the user releases the release button 18 to allow said retainer arm 48 to hold said paper onto said mandrel 40. Thereafter the user places the mandrel 40 end surrounded by paper near and onto the wiping location and performs the required wipe. Once soiled, the paper may be discarded by simply pushing the release button 18, thereby opening the retainer arm 48 and allowing said paper to fall from said mandrel 40 and into the toilet water.

From the foregoing description, those skilled in the art will appreciate that all objects of the present invention are realized. A self wiping toiletry device is described and shown. The apparatus is particularly adapted for assisting handicapped or disabled persons with hygienic toilet use. The self wiping toiletry device of the present invention allows persons with limited hand usage to independently perform wiping after toilet use.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A self wiping toiletry device comprising:

a housing of a substantially "L" shaped form having a first end and a second end and a stem having said first end and a base in the form of a mandrel having said second end; and a hand grip substantially near said stem and mounted with said housing; and a release button substantially near said stem; and a jaw system mounted substantially near said base and capable of opening sufficiently to fit one or more pieces of toilet paper within said jaw system and closing sufficiently to hold said toilet paper; and a linkage connected between said jaw system and said release button whereby opening movement of said release button causes said jaw system to open and create a gap, thereby allowing a user to install and hold said toilet paper whereby said user may use said one or more pieces of toilet paper to wipe after toilet use; and said jaw system comprises a retainer arm pivotably mounted with said mandrel and capable of mating with said mandrel whereby said toilet paper is held; and said retainer arm further comprising an elongated member having a top side which mates with a contour of said mandrel and a rear end having a tab, a linkage hole which mates with said linkage, and a hub which mates with a pivoting shaft of said housing thereby allowing said retainer arm to pivot; and a torsion spring having a first arm and a second end and placed around said hub and pivoting shaft, said torsion spring first arm abutting with said tab and said torsion spring second end abutting against said housing.

2. The self wiping toiletry device as set forth in claim 1 whereby:

said mandrel has one or more grooves having serrations; and said retainer arm has one or more serrations which mate with said mandrel serrations.

3. A self wiping toiletry comprising:

a housing of a substantially "L" shaped form having a first end and a second end and a stem having said first end and a base in the form of a mandrel having said second end; and a hand grip substantially near said stem and mounted with said housing; and a release button substantially near said stem; and a jaw system mounted substantially near said base and capable of opening sufficiently to fit one or more pieces of toilet paper within said jaw system and closing sufficiently to hold said toilet paper; and a linkage connected between said jaw system and said release button whereby opening movement of said release button causes said jaw system to open and create a gap, thereby allowing a user to install and hold said toilet paper whereby said user may use said one or more pieces of toilet paper to wipe after toilet use; and said hand grip substantially rotates on said stem whereby said toilet paper may be rolled prior to installing and holding said toilet paper with said jaw system.

4. The self wiping toiletry device as set forth in claim 3 further comprising:

a grip release locking switch capable of locking said hand grip and prevent said hand grip from rotating.

5. The self wiping toiletry device as set forth in claim 4 whereby:

said hand grip further comprises one or more notches which mate with one or more projections on said grip release locking switch thereby providing the capability of locking said hand grip and preventing said hand grip from rotating.

6. The self wiping toiletry device as set forth in claim 5 whereby:

said housing has an opening capable of slidably holding said grip release locking switch.

7. A self wiping toiletry device comprising:

a housing of a substantially "L" shaped form having a first end and a second end and a stem having said first end and a base in the from of a mandrel having said second end; and a hand grip substantially near said stem and mounted with said housing; and a release button substantially near said stem; and a jaw system mounted substantially near said base and capable of opening sufficiently to fit one or more pieces of toilet paper within said jaw system and closing sufficiently to hold said toilet paper; and a linkage connected between said jaw system and said release button whereby opening movement of said release button causes said jaw system to open and create a gap, thereby allowing a user to install and hold said toilet paper whereby said user may use said one or more pieces of toilet paper to wipe after toilet use; and a cavity having one or more guides for positioning said linkage within said cavity; and one or more pivoting shafts for holding said jaw system; and an elongated member having one or more slots which mate with said guides within said cavity and a first end with said release button and a second end with one or more positioning shafts.

8. A self wiping toiletry device comprising:

a housing of a substantially "L" shaped form having a first end and a second end and a stem having said first end and a base in the form of a mandrel having said second end; and a hand grip substantially near said stem and mounted with said housing; and a release button substantially near said stem; and a jaw system mounted substantially near said base and capable of opening sufficiently to fit one or more pieces of toilet paper within said jaw system and closing sufficiently to hold said toilet paper; and a linkage connected between said jaw system and said release button whereby opening movement of said release button causes said jaw system to open and create a gap, thereby allowing a user to install and hold said toilet paper whereby said user may use said one or more pieces of toilet paper to wipe after toilet use; and one or more extending rings which mate with an interior of said hand grip, thereby holding said hand grip onto said housing.

9. A self wiping toiletry device comprising:

a nearly "L" shaped housing a stem, a base, a cavity, a linkage within said cavity, a jaw system mating with said base and capable of holding one or more pieces of toilet paper, and a hand grip on said stem; and said linkage having a first end with a release button and a second end connected with said jaw system whereby opening movement of said linkage causes said jaw system to open thereby allowing said toilet paper to be placed onto said base and used for wiping after toilet use; and said hand grip rotates upon said stem thereby allowing said toilet paper to be rolled prior to placement upon said base.

10. The self wiping toiletry device as set forth in claim 9, further comprising:

a grip release locking switch slidably mounted within an opening within said stem; and said switch having a projection which mates with one or more notches within said hand grip thereby allowing said hand grip to be locked and not rotate.

11. The self wiping toiletry device as set forth in claim 9, said jaw system further comprising:

said retainer arm mounted with said housing having a top side contoured to mate with said base, a rear end having a hub which pivotably mates with a pivoting shaft within said cavity, and a spring normally biasing said retainer arm against said base when opening movement is not supplied to said linkage.

12. The self wiping toiletry device as set forth in claim 11, said jaw system further comprising:

one or more serrations on said retainer arm or said base.

* * * * *